US011766859B2

(12) United States Patent
Kobayashi et al.

(10) Patent No.: US 11,766,859 B2
(45) Date of Patent: Sep. 26, 2023

(54) PRINTER, CONTROL METHOD, AND NON-TRANSITORY COMPUTER-READABLE MEDIUM STORING COMPUTER-READABLE INSTRUCTIONS

(71) Applicant: BROTHER KOGYO KABUSHIKI KAISHA, Nagoya (JP)

(72) Inventors: Tetsuro Kobayashi, Chiryu (JP); Shuichi Tamaki, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 110 days.

(21) Appl. No.: 17/583,573

(22) Filed: Jan. 25, 2022

(65) Prior Publication Data

US 2022/0234346 A1 Jul. 28, 2022

(30) Foreign Application Priority Data

Jan. 28, 2021 (JP) ..... 2021-011953

(51) Int. Cl.
*B41J 2/045* (2006.01)

(52) U.S. Cl.
CPC ..... *B41J 2/04505* (2013.01); *B41J 2/04581* (2013.01)

(58) Field of Classification Search
CPC ..... B41J 2/04508; B41J 2/04526; B41J 2/04556; B41J 2/04558; B41J 3/4078; B41J 2203/011; B41J 2/04505; B41J 11/06; B41J 11/20; B41J 11/0095
See application file for complete search history.

(56) References Cited

U.S. PATENT DOCUMENTS

2019/0283399 A1* 9/2019 Arakane ..... B41J 2/04586
2020/0086665 A1* 3/2020 Komiya ..... B41J 3/4078
2020/0276845 A1* 9/2020 Murayama ..... B41J 29/38

FOREIGN PATENT DOCUMENTS

JP 2014004707 A 1/2014

* cited by examiner

*Primary Examiner* — Kristal Feggins
(74) *Attorney, Agent, or Firm* — K&L Gates LLP

(57) ABSTRACT

A processor of a printer conveys a platen relative to a head in a conveyance direction, toward a printing position. The printing position is a position at which a nozzle surface of the head faces the platen in a discharge direction. The printer is provided with a first sensor. The first sensor detects a print medium positioned at a first detection position. The first detection position is a position separated from the nozzle surface in the discharge direction. When the print medium is detected by the first sensor after a start of conveyance of the platen, the processor moves the platen relative to the nozzle surface and separates the platen from the nozzle surface in the discharge direction. After that, the processor conveys the platen relative to the head in the conveyance direction, toward the printing position.

8 Claims, 12 Drawing Sheets

PRINTER, CONTROL METHOD, AND NON-TRANSITORY COMPUTER-READABLE MEDIUM STORING COMPUTER-READABLE INSTRUCTIONS

CROSS-REFERENCE TO RELATED APPLICATION

This application claims priority to Japanese Patent Application No. 2021-011953 filed Jan. 28, 2021. The contents of the foregoing application are hereby incorporated herein by reference.

BACKGROUND

The present disclosure relates to a printer, a control method, and a non-transitory computer-readable medium storing computer-readable instructions.

A printer is provided with a check sensor, and performs printing on a print medium on a set tray. At the time of printing, the set tray is conveyed from a set position to a stand-by position. After that, the set tray is turned back from the stand-by position and is conveyed toward a printing position. The printing is performed at the printing position, and the set tray is returned to the set position. The check sensor detects wrinkling of the print medium on the set tray. When the set tray is conveyed from the set position to the printing position, if the wrinkling of the print medium is detected by the check sensor, the set tray is returned to the set position without the printer performing the printing.

SUMMARY

In the above-described printer, when the wrinkling of the print medium is detected by the check sensor, a user smooths out the wrinkling of the print medium in a state in which the set tray has been returned to the set position. Thus, there is a possibility that printing productivity may deteriorate.

Embodiments of the broad principles derived herein provide a printer, a control method, and a non-transitory computer-readable medium storing computer-readable instructions.

A first aspect of the present disclosure relates to a printer including: a head provided with a nozzle surface; a platen configured to support a print medium, the platen configured to move relative to the head in a discharge direction of ink by the head, and in a conveyance direction intersecting the discharge direction; a first sensor configured to detect the print medium positioned at a first detection position, the first detection position being separated by a first detection distance from the nozzle surface in the discharge direction; a processor; and a memory storing computer-readable instructions that, when executed by the processor, cause the processor to perform processes comprising: performing first conveyance processing of conveying the platen in the conveyance direction relative to the head, toward a printing position at which the nozzle surface faces the platen in the discharge direction; performing first separation processing of moving the platen relative to the nozzle surface and separating the platen from the nozzle surface in the discharge direction, when the print medium is detected by the first sensor after a start of the first conveyance processing; and performing second conveyance processing of conveying the platen in the conveyance direction relative to the head, toward the printing position, after performing the first separation processing.

Since the first separation processing and the second conveyance processing are performed even when the print medium is at the first detection position, it is not necessary for a user to rearrange the print medium on the platen. Thus, the printer can improve printing productivity.

A second aspect of the present disclosure relates to a control method of a printer, the control method including: performing first conveyance processing of conveying a platen relative to a head in a conveyance direction, toward a printing position, the platen configured to support a print medium, the conveyance direction being intersecting to a discharge direction of ink by the head, and the printing position being a position at which a nozzle surface of the head faces the platen in the discharge direction; performing first separation processing of moving the platen relative to the nozzle surface and separating the platen from the nozzle surface in the discharge direction, when, after a start of the first conveyance processing, the print medium is detected by a first sensor configured to detect the print medium positioned at a first detection position separated from the nozzle surface in the discharge direction by a first detection distance; and performing second conveyance processing of conveying the platen in the conveyance direction relative to the head, toward the printing position, after performing the first conveyance processing.

The second aspect can achieve the same effects as those of the first aspect.

A third aspect of the present disclosure relates to a non-transitory computer-readable medium storing computer-readable instructions that, when executed, cause a computer of a printer to perform processes including: performing first conveyance processing of conveying a platen relative to a head in a conveyance direction, toward a printing position, the platen configured to support a print medium, the conveyance direction being intersecting to a discharge direction of ink by the head, and the printing position being a position at which a nozzle surface of the head faces the platen in the discharge direction; performing first separation processing of moving the platen relative to the nozzle surface and separating the platen from the nozzle surface in the discharge direction, when, after a start of the first conveyance processing, the print medium is detected by a first sensor configured to detect the print medium positioned at a first detection position separated from the nozzle surface in the discharge direction by a first detection distance; and performing second conveyance processing of conveying the platen in the conveyance direction relative to the head, toward the printing position, after performing the first conveyance processing.

The third aspect can achieve the same effects as those of the first aspect.

BRIEF DESCRIPTION OF THE DRAWINGS

Embodiments will be described below in detail with reference to the accompanying drawings in which.

DETAILED DESCRIPTION

Figure 1:
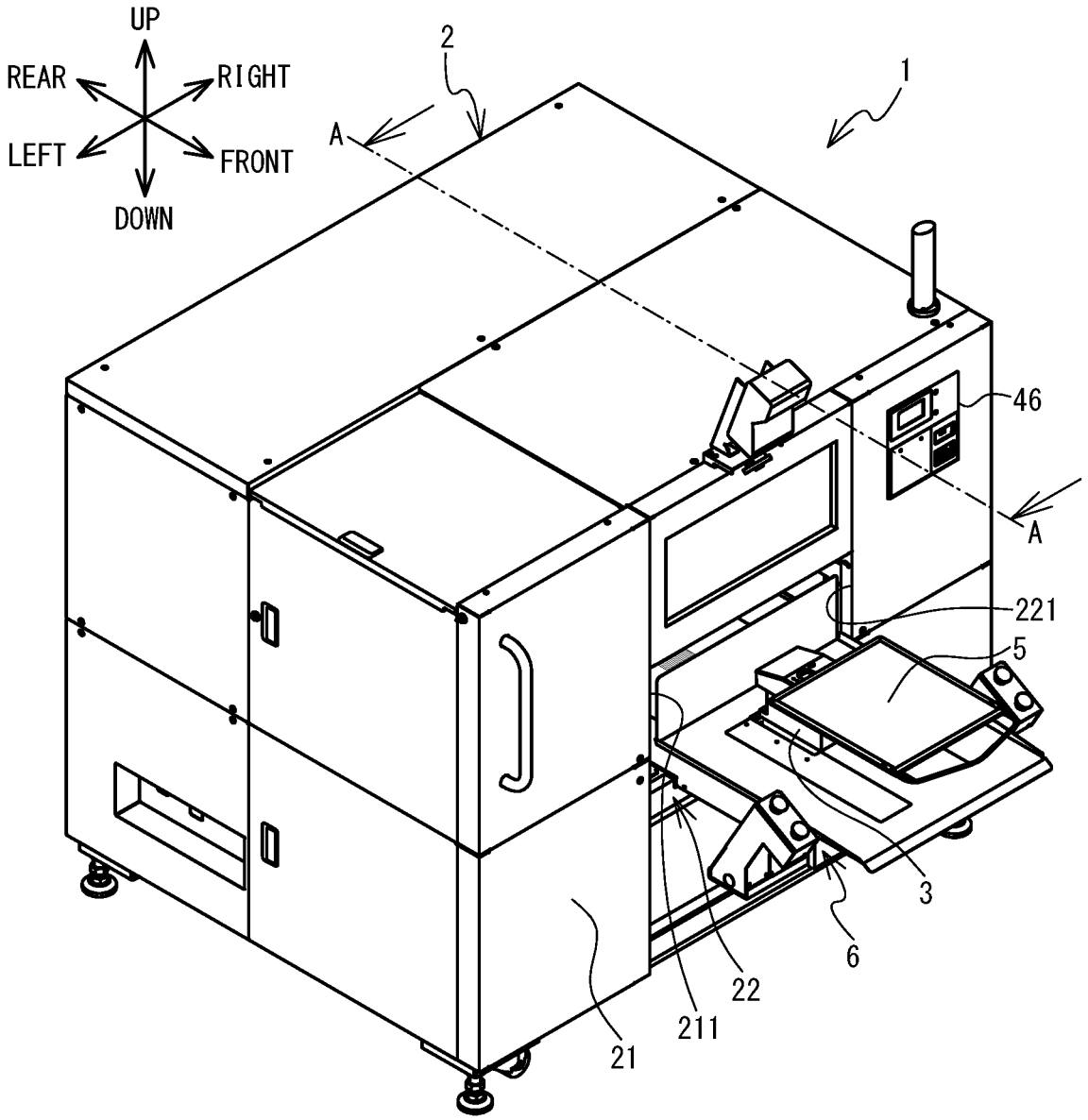
FIG. 1 is a perspective view of a printer as seen from the front left and above.

A printer 1 according to an embodiment of the present disclosure will be explained with reference to the drawings. The upper side, the lower side, the lower left side, the upper right side, the lower right side, and the upper left side in FIG. 1 are, respectively, an upper side, a lower side, a left side, a right side, a front side, and a rear side of the printer 1. In the present embodiment, mechanical elements in the drawings indicate an actual scale.

Figure 2:
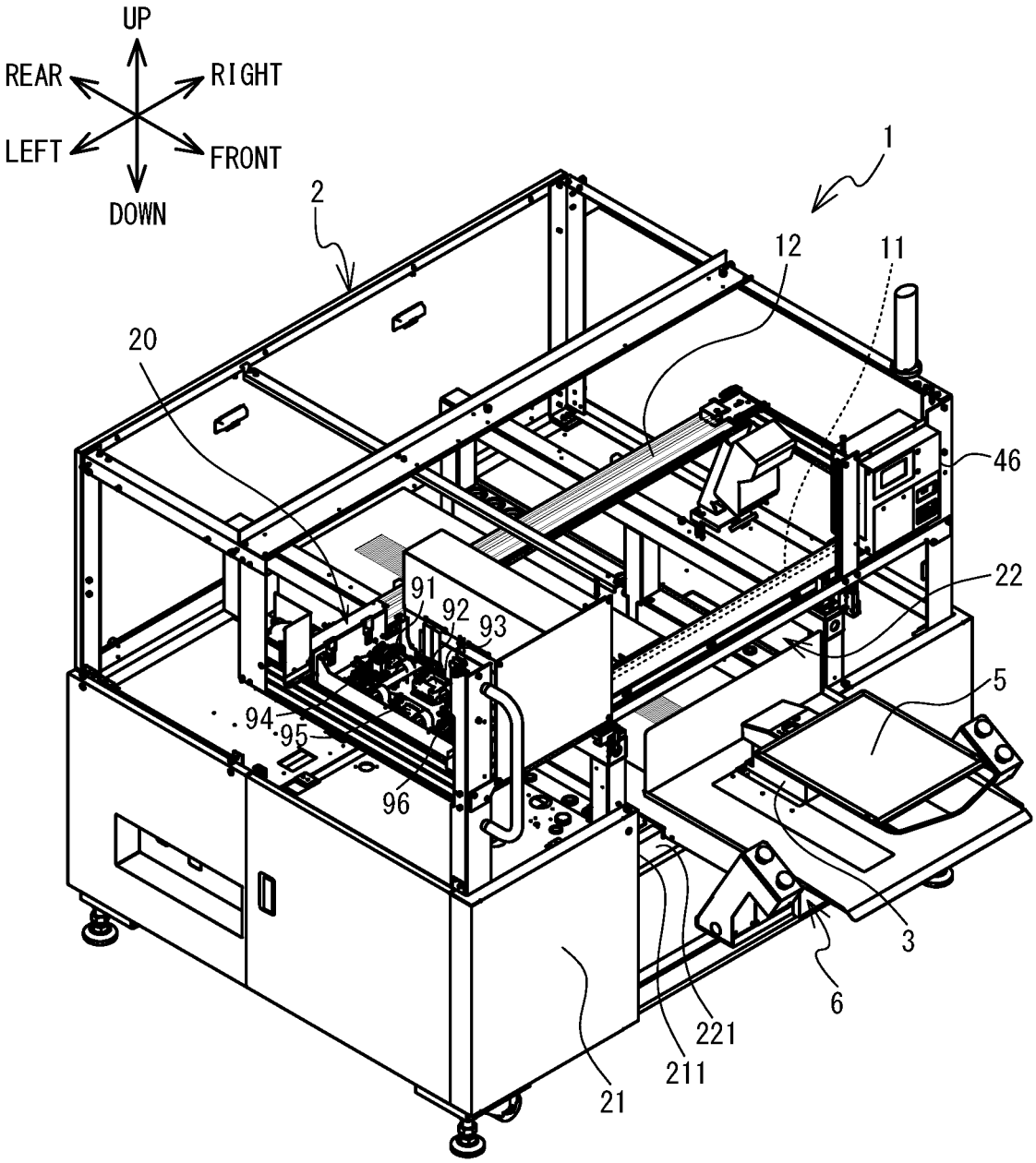
FIG. 2 is a perspective view of the printer as seen from the front left and above, without an upper portion of a housing.

An overall configuration of the printer 1 will be explained with reference to FIG. 1 to FIG. 3. As shown in FIG. 1 and FIG. 2, the printer 1 is provided with a housing 2, a platen conveyance mechanism 6, and a platen 5. The housing 2 is a cuboid shape and includes a front wall 21. A hole 22 is formed in the housing 2. The hole 22 extends from a central portion of the front wall 21 toward the rear. Hereinafter, of the hole 22, a region surrounded by the front wall 21 is referred to as an "opening 221." In other words, the opening 221 is a front end of the hole 22. An input portion 46 is provided in the front wall 21, diagonally to the right and above the opening 221. A user inputs various information to the printer 1 by operating the input portion 46.

Figure 3:
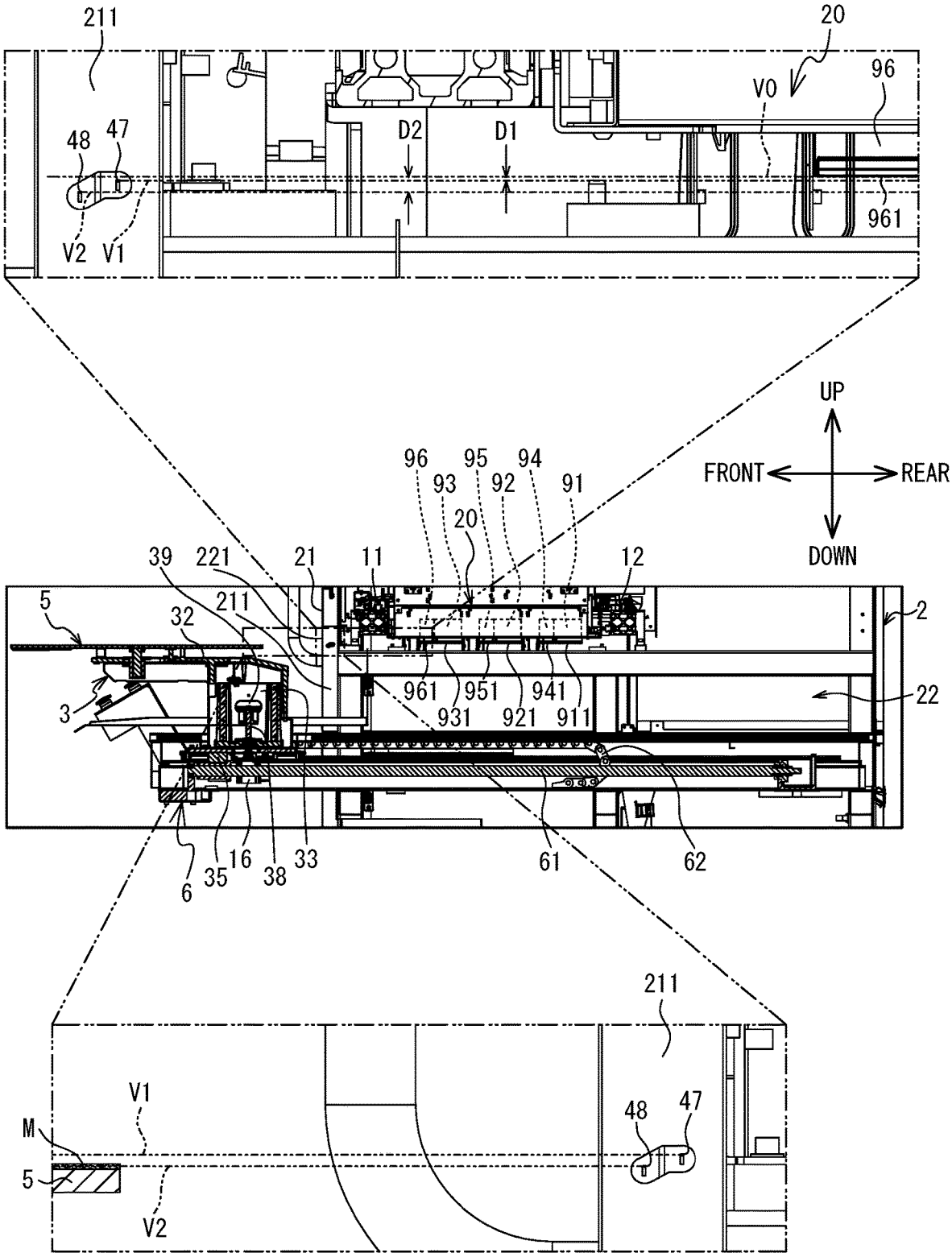
FIG. 3 includes cross-sectional views as seen in the direction of arrows along a line A-A, when a platen is positioned at a set position.
Figure 6:
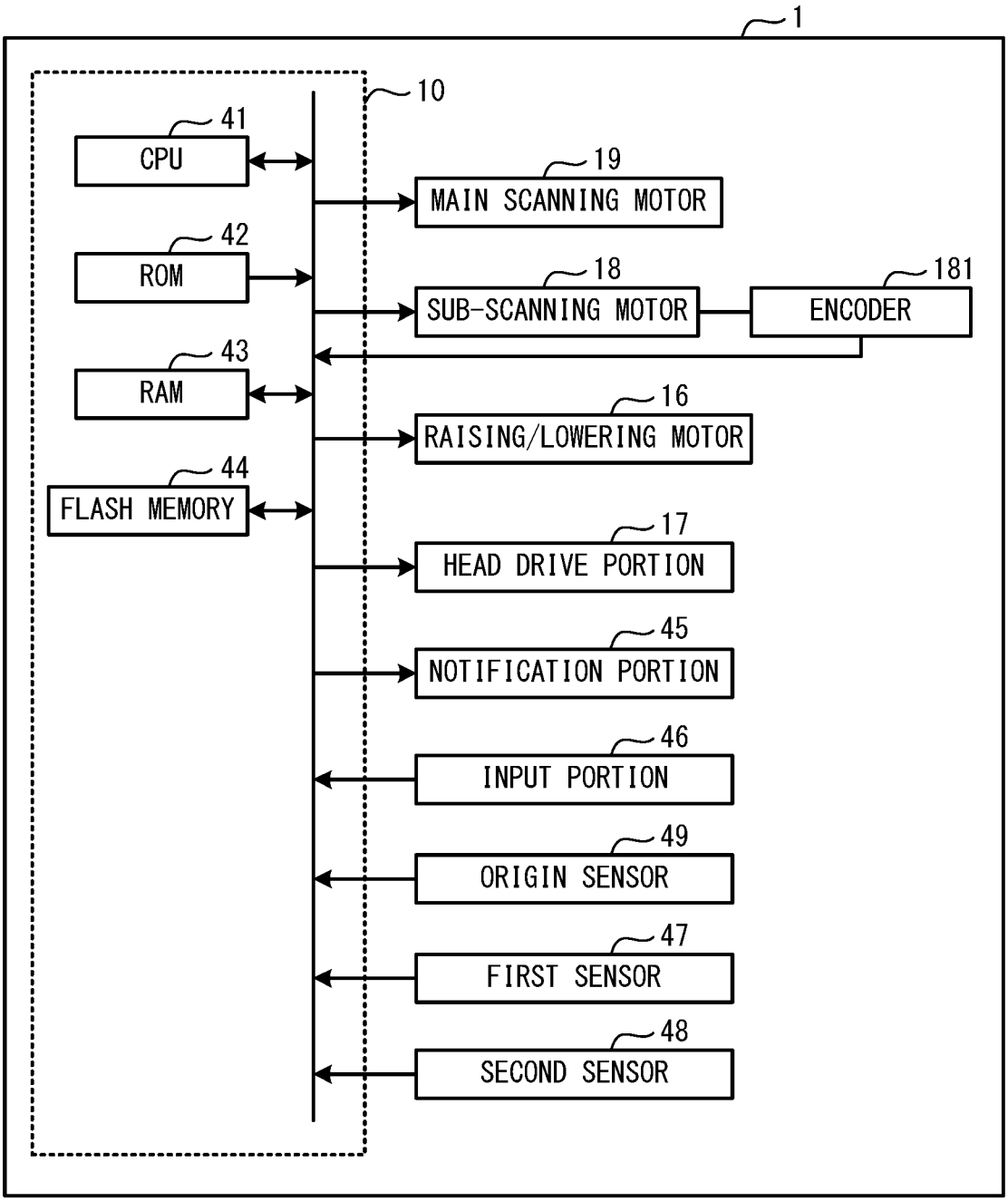
FIG. 6 is a block diagram showing an electrical configuration of the printer.

As shown in FIG. 3, the platen conveyance mechanism 6 is provided, for example, with a shaft 61, a conveyance belt 62, a platen support member 3, a coupling portion 35, a sub-scanning motor 18 shown in FIG. 6, and a raising/lowering motor 16. The shaft 61 and the conveyance belt 62 are provided in a lower portion of the hole 22, and each extends in the front-rear direction. The front end of the shaft 61 extends further to the front side than the opening 221.

The platen support member 3 is provided above the shaft 61 and includes a first section 32 and a second section 33. The first section 32 is plate-shaped and extends in the horizontal direction. The second section 33 extends downward from the rear end portion of the first section 32. The coupling portion 35 is positioned below the second section 33 and is supported by the shaft 61. One end of the conveyance belt 62 is coupled to the coupling portion 35. The sub-scanning motor 18 shown in FIG. 6 is coupled to the other end of the conveyance belt 62.

The raising/lowering motor 16 is fixed to a rear portion of the coupling portion 35. An output shaft of the raising/lowering motor 16 extends upward. A ball screw 38 is fixed to the output shaft of the raising/lowering motor 16. A nut 39 is fixed inside the second section 33. The ball screw 38 is screwed into the nut 39. The platen support member 3 is coupled to the coupling portion 35 by the ball screw 38 and the nut 39 being screwed together.

According to the configuration of the above-described platen conveyance mechanism 6, when the raising/lowering motor 16 is driven, the ball screw 38 rotates with respect to the nut 39. In this way, the platen support member 3 moves up and down. When the sub-scanning motor 18 is driven, the conveyance belt 62 moves the coupling portion 35 in the front-rear direction along the shaft 61. In this way, the platen support member 3 moves in the front-rear direction.

The platen 5 is the shape of a plate that extends in the horizontal direction. The platen 5 is supported by the upper surface of the platen support member 3. A print medium M is placed on the upper surface of the platen 5. The print medium M is a cloth, paper, or the like, and is a T-shirt, for example. The platen 5 can be moved in the front-rear direction and the up-down direction by the platen conveyance mechanism 6. The platen 5 moves in the front-rear direction together with the platen support member 3. In other words, the front-rear direction of the printer 1 is a sub-scanning direction. Furthermore, the platen 5 moves in the up-down direction together with the platen support member 3.

As shown in FIG. 2, the printer 1 is provided with guide rails 11 and 12, a carriage 20, and heads 91 to 96, inside the housing 2. The guide rail 11 is provided in an upper portion of the hole 22 to the rear of the front wall 21, and extends in the left-right direction. The guide rail 12 is provided to the rear of the guide rail 11, and extends in the left-right direction. The carriage 20 is positioned between the guide rail 11 and the guide rail 12 in the front-rear direction, and is supported by the guide rail 11 and the guide rail 12. The carriage 20 moves in the left-right direction along the guide rail 11 and the guide rail 12 as a result of the driving of a main scanning motor 19 shown in FIG. 6.

The heads 91 to 96 are mounted to the carriage 20, and move in the left-right direction together with the carriage 20. In other words, the left-right direction of the printer 1 is a main scanning direction. The heads 91, 92, and 93 are disposed on the right portion of the carriage 20, and are aligned in a row from the rear toward the front in the order of the heads 91, 92, and 93. The heads 94, 95, and 96 are disposed to the left of the row of the heads 91, 92, and 93, and are aligned in a row from the rear toward the front in the order of the heads 94, 95, and 96. In the front-rear direction, the head 94 is disposed between the heads 91 and 92, the head 95 is disposed between the heads 92 and 93, and the head 96 is disposed at a position displaced to the front with respect to the head 93.

As shown in FIG. 3, nozzle surfaces 911, 921, 931, 941, 951, and 961 are provided, respectively, in the lower surfaces of the heads 91 to 96. A nozzle position V0 indicates a position, in the up-down direction, of the nozzle surfaces 911, 921, 931, 941, 951, and 961, and is prescribed by the carriage 20. In the present embodiment, the nozzle position V0 is positioned lower than the lower surface of the carriage 20.

The nozzle position V0 is defined by the lowermost surface of the carriage 20 and the heads 91 to 96. In the present embodiment, the nozzle surfaces 911, 921, 931, 941, 951, and 961 are positioned lower than the bottom surface of the carriage 20, and thus, the position in the up-down direction of the nozzle surfaces 911, 921, 931, 941, 951, and 961 is the nozzle position V0. For example, the bottom surface of the carriage 20 may be positioned lower than the nozzle surfaces 911, 921, 931, 941, 951, and 961. In this case, the position in the up-down direction of the bottom surface of the carriage 20 is the nozzle position V0.

A plurality of nozzles (not shown in the drawings) are aligned in the front-rear direction and the left-right direction in each of the nozzle surfaces 911, 921, 931, 941, 951, and 961. The heads 91 and 94 discharge white ink downward from each of the nozzles. The heads 92 and 95 discharge a pretreatment agent, special ink, and the like downward from each of the nozzles. The heads 93 and 96 discharge color ink downward from each of the nozzles.

A conveyance operation of the platen 5 by the platen conveyance mechanism 6 and a printing operation by the heads 91 to 96 will be explained with reference to FIG. 3 to FIG. 5. When the conveyance operation to convey the platen 5 by the platen conveyance mechanism 6 is started, the platen 5 is conveyed to the rear from a set position shown in FIG. 3 to a return position shown in FIG. 4. The platen 5 is turned back at the return position shown in FIG. 4 and is conveyed toward the front to the set position shown in FIG. 3. In this way, the conveyance operation of the platen 5 by the platen conveyance mechanism 6 ends.

As shown in FIG. 3, the set position is a position at which the platen 5 is disposed further to the front than the front wall 21. For example, the set position is a front end of a movement range of the platen 5, and is a start point and an end point of a conveyance path of the platen 5. The set position is a stand-by position of the platen 5 before the start of printing and after the end of the printing by the printer 1. The set position is a position of the platen 5 when the print medium M is attached to or removed from the platen 5. In the present embodiment, when the platen 5 is positioned at the set position, the rear end of the platen 5 is disposed further to the front than the opening 221.

Figure 4:
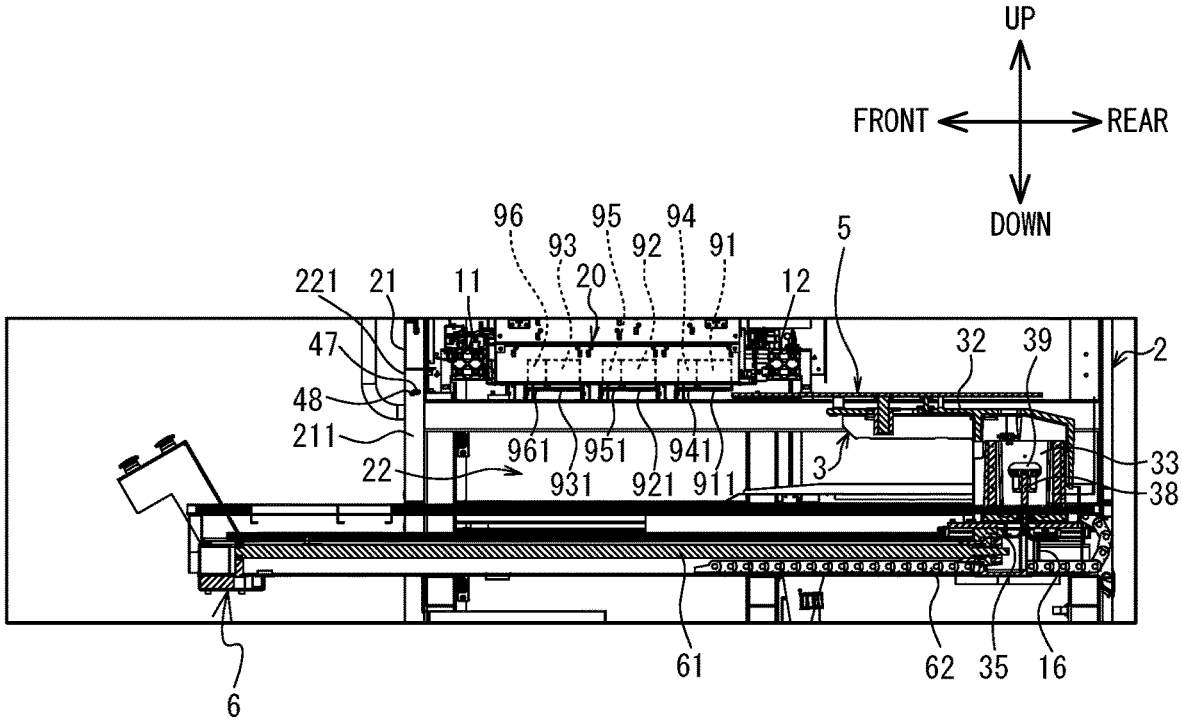
FIG. 4 is a cross-sectional view as seen in the direction of the arrows along the line A-A when the platen is positioned at a return position.

As shown in FIG. 4, the return position is a rear end of the movement range of the platen 5, and is an intermediate position on the conveyance path of the platen 5. In the present embodiment, when the platen 5 is positioned at the return position, the front end of the platen 5 is disposed further to the rear than any of the heads 91 to 96.

Figure 5:
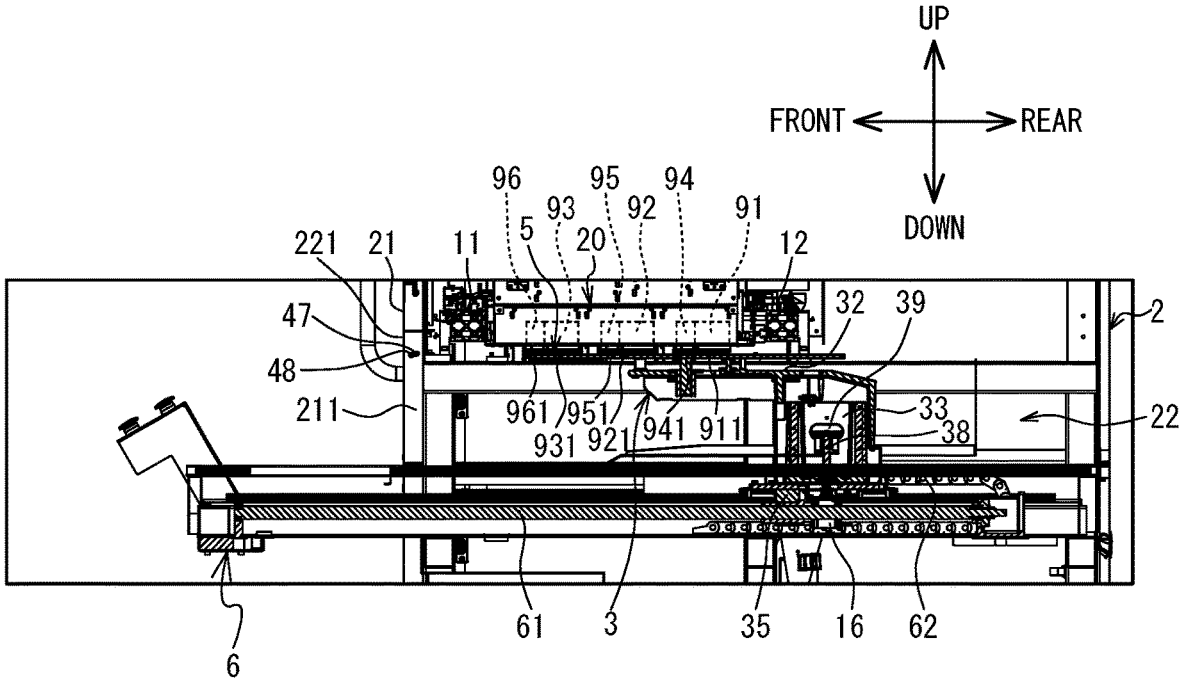
FIG. 5 is a cross-sectional view as seen in the direction of the arrows along the line A-A when the platen is positioned at a printing position.

As shown in FIG. 5, the platen 5 passes through a printing position in the course of the conveyance operation. The printing position is a position at which the platen 5 faces one of the heads 91 to 96 in the up-down direction, is further to the rear than the set position shown in FIG. 3, and is further to the front than the return position shown in FIG. 4.

The printer 1 moves the platen 5 in the front-rear direction (the sub-scanning direction) between the set position shown in FIG. 3 and the return position shown in FIG. 4, and also moves the heads 91 to 96 in the left-right direction (the main scanning direction) on the conveyance path of the platen 5. In this way, the printer 1 conveys the print medium M (refer to FIG. 3) on the platen 5 in the front-rear direction and the left-right direction with respect to the heads 91 to 96. While conveying the print medium M on the platen 5 with respect to the heads 91 to 96, in a state in which the platen 5 is positioned at the printing position, the printer 1 discharges the ink from each of the nozzles of the heads 91 to 96. In this way, the printer 1 performs the printing on the print medium M.

The electrical configuration of the printer 1 will be explained with reference to FIG. 6. The printer 1 is provided with a control board 10. A CPU 41, a ROM 42, a RAM 43, and a flash memory 44 are provided on the control board 10. The CPU 41 controls the printer 1 and is electrically connected to the ROM 42, the RAM 43, and the flash memory 44. The ROM 42 stores a control program used for the CPU 41 to control operations of the printer 1, and various pieces of information and the like needed by the CPU 41 when executing various programs. The ROM 42 stores, on the basis of a rotation angle of the sub-scanning motor 18, the position of the platen 5 in the front-rear direction (the set position, the printing position, the return position, a detection zone to be described later, and the like). The RAM 43 temporarily stores various data used by the control program. The flash memory 44 is a non-volatile memory, and stores a first retry setting, a second retry setting, print data for performing the printing (all to be described later), and the like.

The main scanning motor 19, the sub-scanning motor 18, the raising/lowering motor 16, a head drive portion 17, a notification portion 45, the input portion 46, an origin sensor 49, a first sensor 47, and a second sensor 48 are electrically connected to the CPU 41. The main scanning motor 19, the sub-scanning motor 18, the raising/lowering motor 16, and the head drive portion 17 are driven by control by the CPU 41.

An encoder 181 is provided in the sub-scanning motor 18. The encoder 181 detects the rotation angle of the sub-scanning motor 18, and outputs a detection result to the CPU 41. The head drive portion 17 is a piezoelectric element or the like, and, as a result of the driving of the head drive portion 17, the heads 91 to 96 are caused to discharge the ink from each of the nozzles.

The notification portion 45 is a speaker, a display screen, or the like, and outputs an error sound, an error screen, or the like. The input portion 46 is a touch panel or the like, and outputs information to the CPU 41 in accordance with an operation by the user. By operating the input portion 46, the user can input, to the printer 1, a printing command for starting the printing by the printer 1, and the like.

The origin sensor 49 is provided in the raising/lowering motor 16, and can detect an origin of a rotation position of the raising/lowering motor 16. When the origin sensor 49 has detected the origin of the rotation position of the raising/lowering motor 16, the origin sensor 49 outputs a detection signal to the CPU 41. On the basis of the detection signal from the origin sensor 49, the CPU 41 can determine whether the rotation position of the raising/lowering motor 16 is positioned at the origin.

As shown in FIG. 3, the first sensor 47 and the second sensor 48 are provided on a left edge 211. The left edge 211 is a portion of the front wall 21 that prescribes the left end of the opening 221, and extends in the up-down direction. The second sensor 48 is positioned diagonally to the front of and below the first sensor 47. The first sensor 47 and the second sensor 48 are reflective optical sensors, and each is provided with a light emitting portion and a light receiving portion. The first sensor 47 and the second sensor 48 each emit light to the right from the light emitting portion, and receive the light using the light receiving portion.

The first sensor 47 can detect the print medium M positioned at a first detection position V1. The first detection position V1 is a position in the up-down direction of the first sensor 47, and is, for example, a position in the up-down direction of the light emitting portion and the light receiving portion of the first sensor 47. The first detection position V1 is a position separated downward by a predetermined first detection distance D1 from the nozzle position V0. For example, when the first sensor 47 has detected the print medium M that is at the first detection position V1, the first sensor 47 outputs a detection signal to the CPU 41. On the basis of the detection signal from the first sensor 47, the CPU 41 can determine whether or not the print medium M on the platen 5 is positioned at the first detection position V1.

The second sensor 48 can detect the print medium M positioned at a second detection position V2. The second detection position V2 is a position in the up-down direction of the second sensor 48 and is, for example, a position in the up-down direction of the light emitting portion and the light receiving portion of the second sensor 48. The second detection position V2 is a position separated downward by a predetermined second detection distance D2 from the nozzle position V0. The second detection distance D2 is greater than the first detection distance D1. Thus, the second detection position V2 is positioned lower than the first detection position V1. Note that the first detection distance D1 and the second detection distance D2 are not limited to a particular value, but in the present embodiment, the first detection distance D1 is 1.2 mm and the second detection distance D2 is 4.7 mm. For example, when the second sensor 48 has detected the print medium M that is at the second detection position V2, the second sensor 48 outputs a detection signal to the CPU 41. On the basis of the detection signal from the second sensor 48, the CPU 41 can determine whether or not the print medium M on the platen 5 is positioned at the second detection position V2.

In the present embodiment, in order to reduce a possibility of the print medium M and the heads 91 to 96 coming into contact with each other, when the first sensor 47 has detected the print medium M, the printer 1 does not perform the printing in the state in which the first sensor 47 has detected the print medium M. Furthermore, in order to suppress a deterioration in image quality of a print image caused by landing position displacement of the ink, as a result of the print medium M and the heads 91 to 96 being separated from each other, when the second sensor 48 has not detected the print medium M, the printer 1 does not perform the printing in the state in which the second sensor 48 has not detected the print medium M. Hereinafter, an example of main processing will be explained.

The main processing will be explained with reference to FIG. 3 to FIG. 5 and FIG. 7 to FIG. 12. When a power supply of the printer 1 is turned on, the CPU 41 executes the main processing by reading out the control program from the ROM 42 and operating the control program. In the main processing, the conveyance operation of the platen 5, a print operation by the heads 91 to 96, and the like are performed. Hereinafter, processing at step S45 to step S54, and at step S45 to step S58 will be referred to as "first retry control," and processing at step S63 to step S66 will be referred to as "second retry control." When the main processing is started, it is assumed that the platen 5 is positioned at the set position shown in FIG. 3. The user attaches the unprinted print medium M to the platen 5 in the state in which the platen 5 is positioned at the set position shown in FIG. 3.

Figure 7:
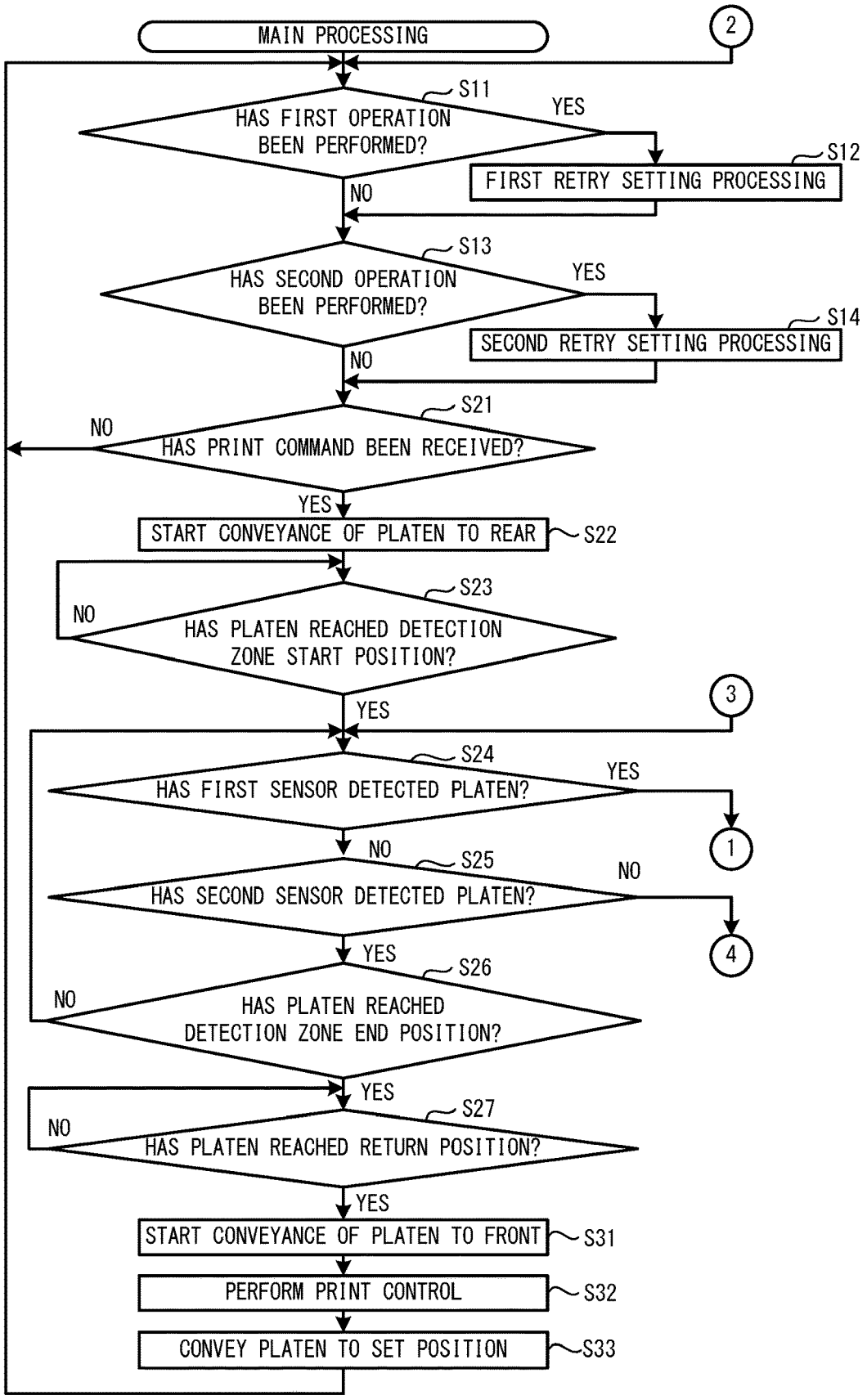
FIG. 7 is a flowchart of main processing.

As shown in FIG. 7, when the main processing is started, the CPU 41 determines whether a first operation has been performed on the input portion 46 (step S11). The first operation is an operation relating to the first retry setting to be described later. When the first operation has not been performed (no at step S11), the CPU 41 shifts the processing to step S13.

When the first operation has been performed (yes at step S11), the CPU 41 performs first retry setting processing (step S12). In the first retry setting processing, the CPU 41 sets, in the flash memory 44, a first retry setting to one of ON or OFF, in accordance with the first operation. When the first retry setting is ON, the CPU 41 decides to perform the first retry control to be described later. When the first retry setting is OFF, the CPU 41 decides not to perform the first retry control. In the first retry setting processing, when the first retry setting is ON, in the flash memory 44, the CPU 41 further sets a length of a first movement distance L1 and of a second movement distance L2 (refer to FIG. 11), to be described later, in accordance with the first operation.

The CPU 41 determines whether or not a second operation has been performed on the input portion 46 (step S13). The second operation is an operation relation to the second retry setting to be described later. When the second operation has not been performed (no at step S13), the CPU 41 shifts the processing to step S21.

When the second operation has been performed (yes at step S13), the CPU 41 performs second retry setting processing (step S14). In the second retry setting processing, the CPU 41 sets, in the flash memory 44, a second retry setting to one of ON or OFF, in accordance with the second operation. When the second retry setting is ON, the CPU 41 decides to perform the second retry control to be described later. When the second retry setting is OFF, the CPU 41 decides not to perform the second retry control.

The CPU 41 determines whether or not a print command has been acquired via the input portion 46 (step S21). When the print command has not been acquired (no at step S21), the CPU 41 returns the processing to step S11. When the print command has been acquired (yes at step S21), the CPU 41 controls the sub-scanning motor 18 and starts to convey the platen 5 to the rear (step S22). In this way, the platen 5 is conveyed from the set position shown in FIG. 3 toward the return position shown in FIG. 4. The CPU 41 performs the following processing while conveying the platen 5.

On the basis of a detection result from the encoder 181, the CPU 41 determines whether or not the platen 5 has reached a detection zone start position (step S23). The detection zone is a zone of the conveyance path of the platen 5 in which the CPU 41 performs control of the conveyance operation or the platen 5 on the basis of the detection signals from the first sensor 47 and the second sensor 48. The detection zone start position is positioned further to the rear than the set position shown in FIG. 3, and is, for example, a position of the platen 5 when the rear end of the platen 5 is positioned at the opening 221. When the platen 5 is positioned at the detection zone start position, the rear end of the platen 5 is, for example, aligned with a position in the front-rear direction of the second sensor 48.

When the platen 5 is positioned further to the front than the detection zone start position (no at step S23), the CPU 41 repeats the processing at step S23. When the platen 5 has reached the detection zone start position (yes at step S23), the CPU 41 determines, on the basis of the detection signal from the first sensor 47, whether or not the print medium M at the first detection position V1 shown in FIG. 3 has been detected by the first sensor 47 (step S24).

As shown in FIG. 3, when there is no wrinkle in the print medium M, or when the wrinkle of the print medium M is relatively small, and the like, the upper surface of the print medium M is positioned lower than the first detection position V1. As shown in FIG. 7, when the print medium M at the first detection position V1 is not detected by the first sensor 47 (no at step S24), the CPU 41 determines, on the basis of the detection signal from the second sensor 48, whether or not the print medium M at the second detection position V2 has been detected by the second sensor 48 (step S25).

As shown in FIG. 3, when the platen 5 has not been excessively lowered, or the like, the upper surface of the print medium M is positioned higher than the second detection position V2. As shown in FIG. 7, when the print medium M at the second detection position V2 has been detected by the second sensor 48 (yes at step S25), the CPU 41 determines, on the basis of the detection result from the encoder 181, whether or not the platen 5 has reached a detection zone end position (step S26). The detection zone end position is a position of the platen 5 when the front end of the platen 5 is positioned at the opening 221, for example.

When the platen 5 is positioned at the detection zone end position, the front end of the platen 5 is, for example, aligned with the position in the front-rear direction of the second sensor 48.

When the platen 5 is positioned further to the front than the detection zone end position (no at step S26), the CPU 41 returns the processing to step S24. When the platen 5 has reached the detection zone end position (yes at step S26), the CPU 41 determines, on the basis of the detection result from the encoder 181, whether or not the platen 5 has reached the return position shown in FIG. 4 (step S27). When the platen 5 is positioned further to the front than the return position shown in FIG. 4 (no at step S27), the CPU 41 repeats the processing at step S27.

When the platen 5 has reached the return position shown in FIG. 4 (yes at step S27), the CPU 41 controls the sub-scanning motor 18 and starts the conveyance of the platen 5 to the front (step S31). In this way, the platen 5 is conveyed from the return position shown in FIG. 4 toward the printing position shown in FIG. 5.

The CPU 41 performs print control in a state in which the platen 5 is positioned at the printing position shown in FIG. 5 (step S32). In the print control, the CPU 41 controls the main scanning motor 19 and the head drive portion 17 in synchronization with the conveyance operation of the platen 5. For example, the carriage 20 reciprocates in the left-right direction while some or all of the heads 91 to 96 discharge the ink from the nozzles, and after that, the platen 5 is conveyed to the front by a predetermined distance. This operation is repeatedly performed. When the printing on the print medium M is complete, the print control is ended.

The CPU 41 controls the sub-scanning motor 18 and conveys the platen 5 to the front to the set position shown in FIG. 3 (step S33). The CPU 41 returns the processing to step S11. The user removes the printed print medium M from the platen 5 in a state in which the platen 5 is positioned at the set position shown in FIG. 3, and, when the printing is to be repeated, attaches the unprinted print medium M to the platen 5.

Figure 8:
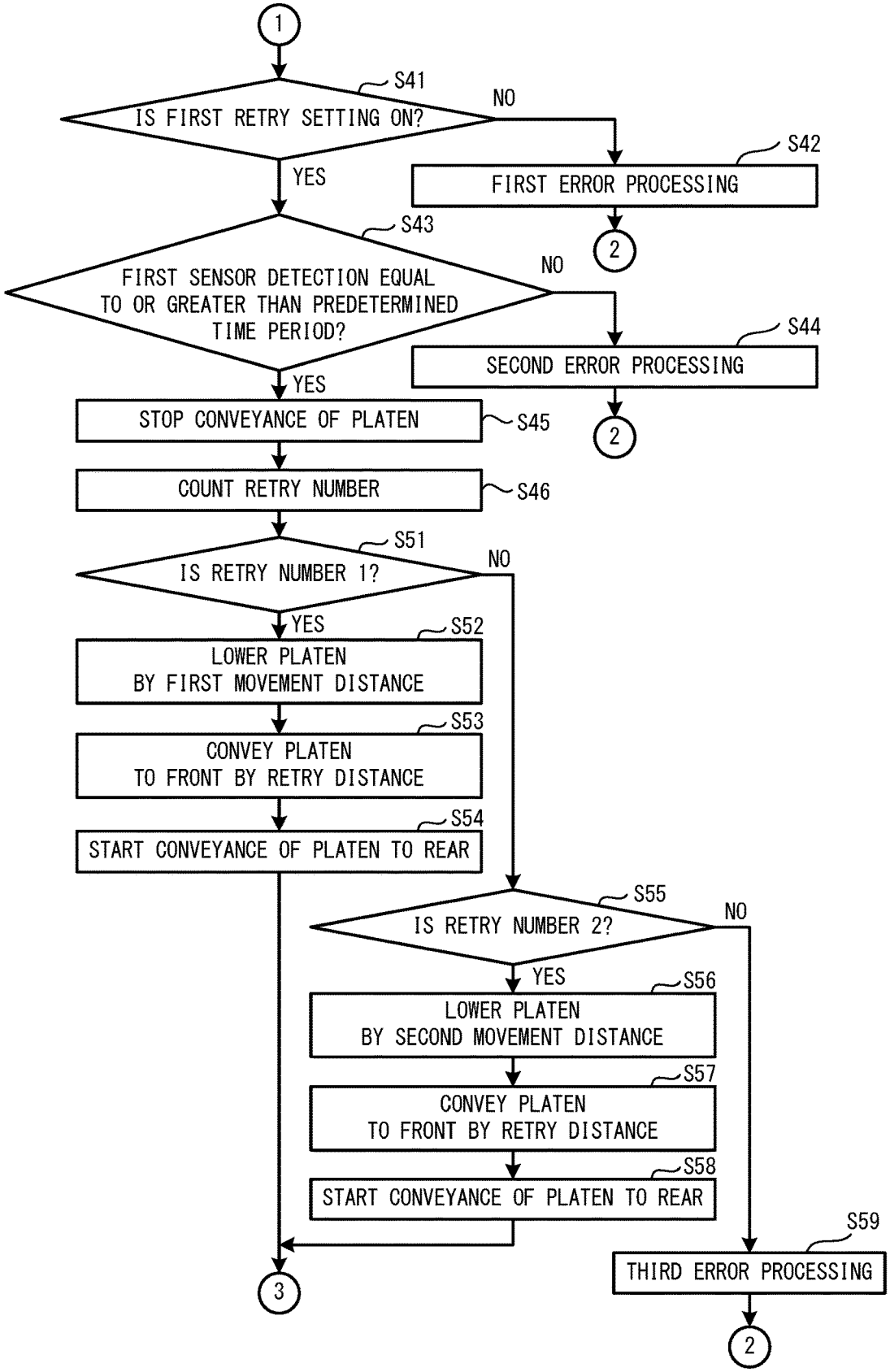
FIG. 8 is a flowchart of the main processing.
Figure 10:
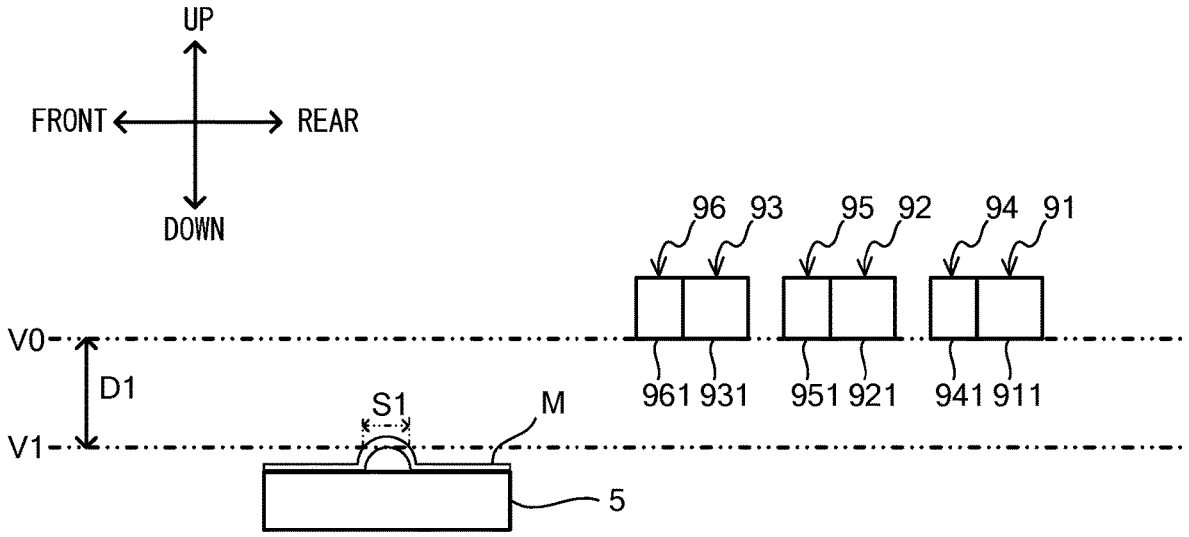
FIG. 10 is a schematic diagram when a wrinkle of a print medium is positioned at a first detection position.
Figure 11:
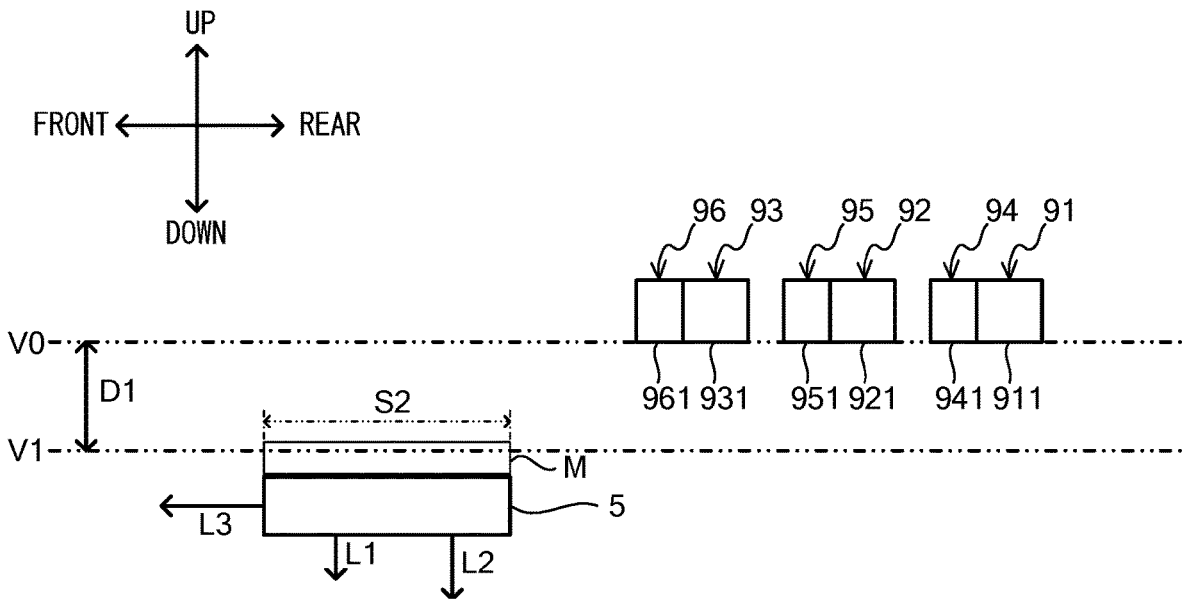
FIG. 11 is a schematic diagram when the thick print medium is positioned at the first detection position.

For example, there is a case in which the print medium M has a wrinkle, as shown in FIG. 10, or a case in which the thickness of the print medium M in the up-down direction is thick, as shown in FIG. 11. In this case, depending on the size of the wrinkle of the print medium M, the thickness of the print medium M in the up-down direction, and the position of the platen 5 in the up-down direction, the upper surface of the print medium M is positioned higher than the first detection position V1. When the upper surface of the print medium M is positioned higher than the first detection position V1, the print medium M at the first detection position V1 is detected by the first sensor 47 (yes at step S24). In this case, as shown in FIG. 8, the CPU 41 refers to the flash memory 44 and determines whether or not the first retry setting is ON (step S41).

When the first retry setting is OFF (no at step S41), the CPU 41 performs first error processing (step S42). In the first error processing, the CPU 41 controls the sub-scanning motor 18 and returns the platen 5 to the set position shown in FIG. 3. In this case, the raising/lowering motor 16 is stopped, and thus, the position of the platen 5 in the up-down direction is maintained to be constant. Furthermore, the CPU 41 causes the notification portion 45 to perform error notification. The error notification in the first error processing refers to indicating the fact that the print medium M in the first detection position V1 has been detected by the first sensor 47, or the like. The CPU 41 returns the processing to step S11 shown in FIG. 7. In this case, in the state in which the platen 5 is positioned at the set position shown in FIG. 3, the user re-arranges the print medium M on the platen 5, replaces the print medium M, or adjusts the position of the platen 5 in the up-down direction. For example, the user operates the input portion 46 and drives the raising/lowering motor 16, and moves the platen 5 downward. Alternatively, the user operates a manual adjustment mechanism (not shown in the drawings) and moves the platen 5 downward. After that, the user once more inputs the print command to the printer 1.

When the first retry setting is ON (yes at step S41), the CPU 41 determines, on the basis of the detection signal from the first sensor 47, whether or not the print medium M at the first detection position V1 is detected by the first sensor 47 for a predetermined time period or more (step S43). The predetermined time period is stored in the ROM 42 and is shorter than a conveyance time period when the platen 5 is conveyed from the detection zone start position to the detection zone end position, for example. The predetermined time period is longer than 0 seconds.

When the print medium M at the first detection position V1 has been detected by the first sensor 47, the case is conceivable, for example, in which the print medium M has the wrinkle, as shown in FIG. 10, or the case in which the thickness of the print medium M in the up-down direction is thick, as shown in FIG. 11. As shown in FIG. 10, when the print medium M has the wrinkle, a detection time period of the detection of the print medium M by the first sensor 47 is a time period corresponding to a distance S1. When the thickness of the print medium M in the up-down direction is thick, as shown in FIG. 11, the detection time period of the detection of the print medium M by the first sensor 47 is a time period corresponding to a distance S2. In most cases, the distance S1 is smaller than the distance S2. Thus, when the print medium M is detected by the first sensor 47 for a time period equal to or greater than the predetermined time period, the possibility that the thickness of the print medium M in the up-down direction is thick is higher than when the print medium M is detected by the first sensor 47 for a time period less than the predetermined time period. On the other hand, when the print medium M is detected by the first sensor 47 for the time period less than the predetermined time period, the possibility that the print medium M has the wrinkle is higher than when the print medium M is detected by the first sensor 47 for the time period equal to or greater than the predetermined time period.

When the print medium M at the first detection position V1 is no longer detected by the first sensor 47 before the predetermined time period has elapsed from when the print medium M at the first detection position V1 is detected by the first sensor 47 (no at step S43), there is a relatively high possibility that the print medium M has the wrinkle (refer to FIG. 10). In this case, the CPU 41 performs second error processing (step S44).

In the second error processing, the CPU 41 controls the sub-scanning motor 18 and returns the platen 5 to the set position shown in FIG. 3. In this case, the raising/lowering motor 16 is stopped, and thus, the position of the platen 5 in the up-down direction is maintained to be constant. Further, the CPU 41 causes the notification portion 45 to perform the error notification. The error notification in the second error processing refers to indicating the fact that the print medium M in the first detection position V1 is detected by the first sensor 47 for less than the predetermined time period, that the print medium M has the wrinkle, and the like. The CPU 41 returns the processing to step S11 in FIG. 7. In this case, in the state in which the platen 5 is positioned at the set position shown in FIG. 3, the user stretches out the wrinkle of the print medium M. After that, the user once more inputs the print command to the printer 1. In this way, the printer 1 can suppress the printing from being performed on the print medium M in a wrinkled state.

When the print medium M at the first detection position V1 is detected by the first sensor 47 for the time period equal to or greater than the predetermined time period (yes at step S43), there is a relatively high possibility that the thickness in the up-down direction of the print medium M is thick (refer to FIG. 11). In this case, the CPU 41 stops the driving of the sub-scanning motor 18 and stops the conveyance of the platen 5 (step S45). The CPU 41 counts a retry number and stores the number in the RAM 43 (step S46). The retry number is a number of times that the first retry control is performed. Note that the retry number is reset to "0" in the RAM 43 when the print command has been input (yes at step S21). Further, when the print control has been performed (step S32), and when the second to fourth error processing has been performed (step S44, step S59, step S62), the retry number is reset to "0" in the RAM 43.

The CPU 41 refers to the RAM 43 and determines whether or not the retry number is 1 (step S51). When the retry number is 1 (yes at step S51), the CPU 41 controls the raising/lowering motor 16 and lowers the platen 5 by the first movement distance L1 (refer to FIG. 11) set at step S12 (step S52). In this way, the platen 5 is separated, in the up-down direction, from the nozzle surfaces 911, 921, 931, 941, 951, and 961.

The CPU 41 controls the sub-scanning motor 18, and conveys the platen 5 to the front by a predetermined retry distance L3 (refer to FIG. 11) (step S53). In this way, the platen 5 is conveyed to a retry position. In other words, the retry position is a position further to the front, by the retry distance L3, than the position of the platen 5 when the predetermined time period has elapsed from when the print medium M at the first detection position V1 is detected by the first sensor 47. The retry position is a position further to the front, by the retry distance L3, than a stop position of the platen 5 at step S45. The retry distance L3 is stored in the ROM 42 and is constant, regardless of the stop position of the platen 5 at step S45. The retry distance L3 is longer than a distance in the front-rear direction over which the platen 5 is conveyed during the predetermined time period, for example. The retry distance L3 is shorter, for example, than a total distance obtained by adding a distance in the front-rear direction between the set position shown in FIG. 3 and the detection zone start position, and the distance in the front-rear direction over which the platen 5 is conveyed during the predetermined time period. Thus, the retry position is a position further to the front than the detection zone start position, and further to the rear than the set position shown in FIG. 3.

The CPU 41 controls the sub-scanning motor 18 and starts to convey the platen 5 to the rear (step S54). In this way, the platen 5 is conveyed from the retry position toward the return position shown in FIG. 4. The CPU 41 returns the processing to step S24 in FIG. 7. A first cycle of the first retry control (step S45 to step S54) is performed as described above. When the upper surface of the print medium M has been lowered to a position lower than the first detection position V1 as a result of the first cycle of the first retry control, at step S24, the print medium M is not detected by the first sensor 47 (no at step S24). In this case, after that, the print control is performed (step S32). Thus, it is not necessary for the user to rearrange the print medium M on the platen 5, to replace the print medium M, or to adjust the position in the up-down direction of the platen 5 in the state in which the platen 5 is positioned at the set position shown in FIG. 3. As a result, it is not necessary for the user to input the print command once more to the printer 1. As a result, the printer 1 can improve printing productivity.

When the thickness of the print medium M in the up-down direction is relatively thick, when the first movement distance L1 is relatively small, and the like, in the first cycle of the first retry control, that is, in the lowering of the platen 5 by the first movement distance L1, there is a case in which the upper surface of the print medium M is not lowered to a position lower than the first detection position V1. In this case, the print medium M at the first detection position V1 is once more detected by the first sensor 47 for a period equal to or greater than the predetermined time period (yes at step S24; yes at step S41; yes at step S43). In this case, the retry number is not 1 (no at step S51), and the CPU 41 determines whether or not the retry number is 2 (step S55).

When the retry number is 2 (yes at step S55), the CPU 41 controls the raising/lowering motor 16 and lowers the platen 5 by the second movement distance L2 (refer to FIG. 11) set at step S12 (step S56). In this way, the platen 5 is separated, in the up-down direction, from the nozzle surfaces 911, 921, 931, 941, 951, and 961. The CPU 41 controls the sub-scanning motor 18, and conveys the platen 5 to the front by the predetermined retry distance L3 (refer to FIG. 11) (step S57). In this way, the platen 5 is conveyed to the retry position.

The CPU 41 controls the sub-scanning motor 18 and starts to convey the platen 5 to the rear (step S58). In this way, the platen 5 is conveyed from the retry position toward the return position shown in FIG. 4. The CPU 41 returns the processing to step S24 in FIG. 7. A second cycle of the first retry control (step S45 to step S58) is performed as described above. When the upper surface of the print medium M has been lowered to a position lower than the first detection position V1 as a result of the second cycle of the first retry control, at step S24, the print medium M is not detected by the first sensor 47 (no at step S24). In this case, after that, the print control is performed (step S32).

Even in the second cycle of the first retry control, that is, even in the lowering of the platen 5 by the first movement distance L1 and the second movement distance L2, there is a case in which the upper surface of the print medium M is not lowered to a position lower than the first detection position V1. In this case, the print medium M at the first detection position V1 is once more detected by the first sensor 47 for a period equal to or greater than the predetermined time period (yes at step S24; yes at step S41; yes at step S43; no at S51). In this case, the retry number is 3 (no at step S55), and the CPU 41 performs the third error processing (step S59). In other words, in the present embodiment, the first retry control is only performed up to a maximum of two times for each time the print command is input.

In the third error processing, the CPU 41 controls the sub-scanning motor 18 and returns the platen 5 to the set position shown in FIG. 3. In this case, the raising/lowering motor 16 is stopped, and thus, the position of the platen 5 in the up-down direction is maintained to be constant. Further, the CPU 41 causes the notification portion 45 to perform the error notification. The error notification in the third error processing refers to indicating the fact that the second cycle of the first retry control has already been performed, and the like. The CPU 41 returns the processing to step S11 in FIG. 7. In this case, in the state in which the platen 5 is positioned at the set position shown in FIG. 3, the user rearranges the print medium M on the platen 5, replaces the print medium M, or adjusts the position of the platen 5 in the up-down direction. After that, the user once more inputs the print command to the printer 1.

Figure 9:
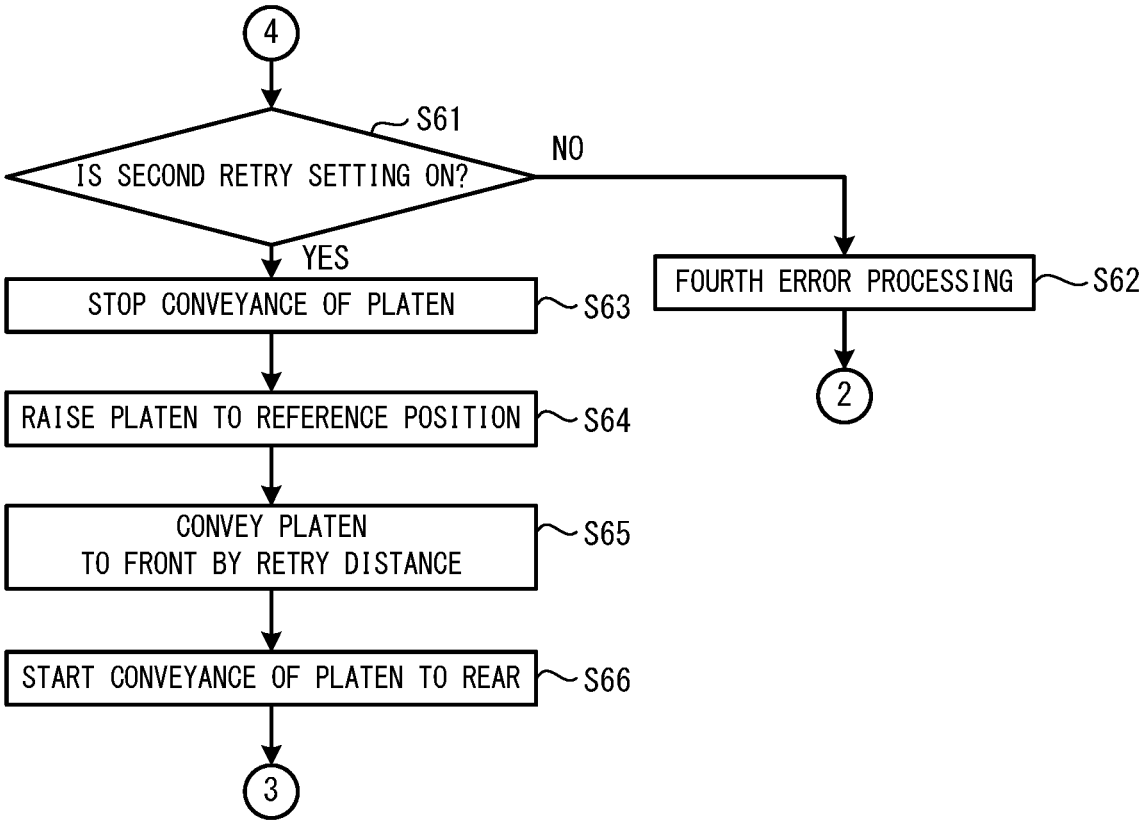
FIG. 9 is a flowchart of the main processing.
Figure 12:
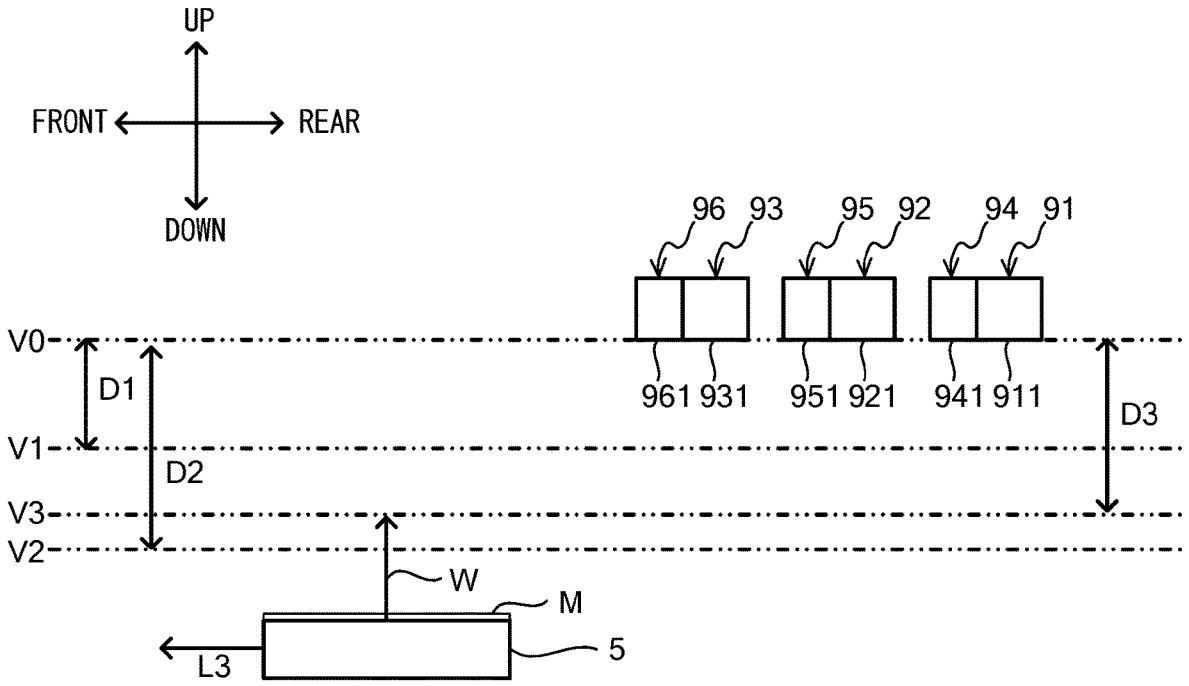
FIG. 12 is a schematic diagram when the print medium is positioned lower than a second detection position.

As shown in FIG. 12, there is a case, for example, in which the platen 5 has been excessively lowered. In this case, the upper surface of the print medium M is positioned lower than the second detection position V2. As shown in FIG. 7, when the upper surface of the print medium M is positioned lower than the second detection position V2, the print medium M at the second detection position V2 is not detected by the second sensor 48 (no at step S25). In this case, as shown in FIG. 9, the CPU 41 refers to the flash memory 44 and determines whether or not the second retry setting is ON (step S61).

When the second retry setting is OFF (no at step S61), the CPU 41 performs the fourth error processing (step S62). In the fourth error processing, the CPU 41 controls the sub-scanning motor 18 and returns the platen 5 to the set position shown in FIG. 3. In this case, the raising/lowering motor 16 is stopped, and thus, the position of the platen 5 in the up-down direction is maintained to be constant. Further, the CPU 41 causes the notification portion 45 to perform the error notification. The error notification in the fourth error processing refers to indicating the fact that the print medium M is not present at a position above the second detection position V2, that the platen 5 has been excessively lowered, and the like. The CPU 41 returns the processing to step S11 in FIG. 7. In this case, in the state in which the platen 5 is positioned at the set position shown in FIG. 3, the user adjusts the position of the platen 5 in the up-down direction. After that, the user once more inputs the print command to the printer 1.

When the second retry setting is ON (yes at step S61), the CPU 41 stops the driving of the sub-scanning motor 18 and stops the conveyance of the platen 5 (step S63). The CPU 41 controls the raising/lowering motor 16 on the basis of the detection signal from the origin sensor 49, and raises the platen 5 to a reference position V3 shown in FIG. 12 (step S64, refer to an arrow W in FIG. 12). In this way, the platen 5 is caused to approach the nozzle surfaces 911, 921, 931, 941, 951, and 961, in the up-down direction. The reference position V3 is a position of the platen 5 in the up-down direction when the rotation position of the raising/lowering motor 16 is positioned at the origin.

As shown in FIG. 12, the reference position V3 is a position separated downward from the nozzle surfaces 911, 921, 931, 941, 951, and 961 by a predetermined reference distance D3. The reference distance D3 is greater than the first detection distance D1 and is smaller than the second detection distance D2. Thus, the reference position V3 is a position between the first detection position V1 and the second detection position V2 in the up-down direction. Note that the reference distance D3 is not limited to a specific value, but in the present embodiment, the reference distance D3 is 4.4 mm.

As shown in FIG. 9, the CPU 41 controls the sub-scanning motor 18 and conveys the platen 5 to the front by the predetermined retry distance L3 (refer to FIG. 12) (step S65). In this way, the platen 5 is conveyed to the retry position. The CPU 41 controls the sub-scanning motor 18 and starts to convey the platen 5 to the rear (step S66). In this way, the platen 5 is conveyed from the retry position toward the return position shown in FIG. 4. The CPU 41 returns the processing to step S24 in FIG. 7. The second retry control is performed (step S63 to step S66) as described above. When the upper surface of the print medium M has been raised to a position higher than the second detection position V2 as a result of the second retry control, at step S25, the print medium M is detected by the second sensor 48 (yes at step S25). In this case, after that, the print control is performed (step S32). Thus, it is not necessary for the user to adjust the position in the up-down direction of the platen 5 in the state in which the platen 5 is positioned at the set position shown in FIG. 3 and once more input the print command to the printer 1. As a result, the printer 1 can improve the printing productivity.

As described above, the printer 1 is provided with the heads 91 to 96, the platen 5, the first sensor 47, and the CPU 41. The nozzle surfaces 911, 921, 931, 941, 951, and 961 are provided on the heads 91 to 96. The platen 5 is provided to be movable relative to the heads 91 to 96 in the up-down direction and the front-rear direction, and supports the print medium M. The direction from up to down is a discharge direction of the ink by the heads 91 to 96. The front-rear direction intersects the up-down direction. The first sensor 47 detects the print medium M at the first detection position V1. The first detection position V1 is the position separated downward from the nozzle surfaces 911, 921, 931, 941, 951, and 961, by the first detection distance D1. The CPU 41 performs first conveyance processing (step S22). In the first conveyance processing, the CPU 41 conveys the platen 5 relative to the heads 91 to 96 in the front-rear direction, toward the printing position. The printing position is the position at which one of the nozzle surfaces 911, 921, 931, 941, 951, and 961 faces the platen 5 in the up-down direction. When the print medium M is detected by the first sensor 47 after the start of the first conveyance processing, the CPU 41 performs first separation processing (step S52). In the first separation processing, the CPU 41 causes the platen 5 to move relative to and move away from the nozzle surfaces 911, 921, 931, 941, 951, and 961 in the up-down direction. After performing the first separation processing, the CPU 41 performs second conveyance processing (step S54). In the second conveyance processing, the CPU 41 conveys the platen 5 relative to the heads 91 to 96 in the front-rear direction, toward the printing position.

Since the first separation processing and the second conveyance processing are performed even when the print medium M is at the first detection position V1, it is not necessary for the user to rearrange the print medium M on the platen 5. Thus, the printer 1 can improve the printing productivity.

The printer 1 is provided with the flash memory 44. The flash memory 44 stores one of ON and OFF for the first retry setting. In the state in which ON is stored in the flash memory 44 for the first retry setting, when the print medium M is detected by the first sensor 47 after the start of the first conveyance processing, the CPU 41 performs the first separation processing. In the state in which OFF is stored in the flash memory 44 for the first retry setting, when the print medium M is detected by the first sensor 47 after the start of the first conveyance processing, the CPU 41 performs the first error processing (step S42). In the first error processing, the CPU 41 performs the error notification.

In the state in which ON is stored in the flash memory 44 for the first retry setting, even when the print medium M is at the first detection position V1, the first separation processing and the second conveyance processing are performed, and thus, the printer 1 can improve the printing productivity. In the state in which OFF is stored in the flash memory 44 for the first retry setting, when the print medium M is at the first detection position V1, the first error processing is performed, and thus, the printer 1 can suppress the printing from being performed on the print medium M in the wrinkled state, for example. Thus, the printer 1 can suppress a deterioration in the image quality of the print image. As a result, by storing one of ON and OFF for the first retry setting in the flash memory 44, the printer 1 can perform the printing in accordance with a respective priority of printing productivity and image quality of the print image, for example.

The printer 1 is provided with the second sensor 48. The second sensor 48 detects the print medium M at the second detection position V2. The second detection position V2 is the position separated downward from the nozzle surfaces 911, 921, 931, 941, 951, and 961 by the second detection distance D2. The second detection distance D2 is greater than the first detection distance D1. When the print medium M is not detected by the second sensor 48 after the start of the first conveyance processing or the second conveyance processing, the CPU 41 performs approach processing (step S64). In the approach processing, the CPU 41 causes the platen 5 to move relative to and approach the nozzle surfaces 911, 921, 931, 941, 951, and 961 in the up-down direction. After performing the approach processing, the CPU 41 performs third conveyance processing (step S66). In the third conveyance processing, the CPU 41 conveys the platen 5 relative to the heads 91 to 96 in the front-rear direction, toward the printing position.

Even when the print medium M is not at the second detection position V2, since the third conveyance processing is performed, it is not necessary for the user to adjust the position of the platen 5 in the up-down direction with respect to the nozzle surfaces 911, 921, 931, 941, 951, and 961. Thus, the printer 1 can improve the printing productivity. Furthermore, the printer 1 can suppress the deterioration in the image quality of the print image as a result of a discharge distance being greater than the second detection distance D2.

In the first conveyance processing, the CPU 41 conveys the platen 5 relative to the heads 91 to 96 in the front-rear direction, from the set position toward the printing position. The set position is the position at which the print medium M is attached to and removed from the platen 5. When the print medium M is detected by the first sensor 47 after the start of the first conveyance processing, after performing the first separation processing, the CPU 41 performs return processing (step S53). In the return processing, the CPU 41 conveys the platen 5 to the retry position. The retry position is a position between the position of the platen 5 when the print medium M is detected by the first sensor 47, and the set position. In the second conveyance processing, the CPU 41 conveys the platen 5 relative to the heads 91 to 96 in the front-rear direction, from the retry position to the printing position.

The conveyance time period of the platen 5 from the retry position to the printing position is shorter than the conveyance time period of the platen 5 from the set position to the printing position. The printer 1 performs the return processing, and thus, the conveyance time period of the platen 5 by the second conveyance processing can be made shorter, compared to when the platen 5 is returned to the set position. Thus, the printer 1 can improve the printing productivity.

In the printer 1, in the first separation processing, the CPU 41 moves the platen 5 relative to the nozzle surfaces 911, 921, 931, 941, 951, and 961 in the up-down direction and separates the platen 5 from the nozzle surfaces 911, 921, 931, 941, 951, and 961 by the first movement distance L1. When the print medium M is detected by the first sensor 47 after the start of the second conveyance processing, the CPU 41 performs second separation processing (step S56). In the second separation processing, the CPU 41 move the platen 5 relative to the nozzle surfaces 911, 921, 931, 941, 951, and 961 in the up-down direction and separates the platen 5 from the nozzle surfaces 911, 921, 931, 941, 951, and 961 by the second movement distance L2. The second movement distance L2 is the distance different from the first movement distance L1. After performing the second separation processing, the CPU 41 performs fourth conveyance processing (step S58). In the fourth conveyance processing, the CPU 41 conveys the platen 5 relative to the heads 91 to 96 in the front-rear direction, toward the printing position.

For example, when the first movement distance L1 is greater than the second movement distance L2, the possibility that the print medium M is detected by the first sensor 47 after the start of the second conveyance processing is lower than when the first movement distance L1 is smaller than the second movement distance L2. Thus, in this case, the printer 1 can improve the printing productivity. For example, when the first movement distance L1 is smaller than the second movement distance L2, the possibility that the distance in the up-down direction between the nozzle surfaces 911, 921, 931, 941, 951, and 961 and the print medium M becomes too large in the first separation processing is smaller than when the first movement distance L1 is greater than the second movement distance L2. Thus, in this case, the printer 1 can suppress the deterioration in the image quality of the print image as a result of the nozzle surfaces 911, 921, 931, 941, 951, and 961 being too far from the print medium M.

The CPU 41 performs the first separation processing when the print medium M is detected by the first sensor 47 for a period equal to or greater than the predetermined time period after the start of the first conveyance processing. The CPU 41 performs the second error processing (step S44) when the print medium M is detected by the first sensor 47 for a period less than the predetermined time period after the start of the first conveyance processing. In the second error processing, the CPU 41 performs the error notification.

When the print medium M is detected by the first sensor 47 for the period equal to or greater than the predetermined time period, the possibility that the thickness in the up-down direction of the print medium M is thick is higher than when the print medium M is detected by the first sensor 47 for the period less than the predetermined time period. In this case, the printer 1 can improve the printing productivity by performing the first separation processing and the second conveyance processing. On the other hand, when the print medium M is detected by the first sensor 47 for the period less than the predetermined time period, the possibility that the print medium M has the wrinkle is higher than when the print medium M is detected by the first sensor 47 for the period equal to or greater than the predetermined time period. In this case, by performing the second error processing, the printer 1 can suppress the printing from being performed on the print medium M that has the wrinkle.

Modifications can be made to the present disclosure from the above-described embodiment. Various modified examples to be described below can be respectively combined insofar as no contradictions arise. For example, in the above-described embodiment, the number of the heads 91 to 96 may be more than six or may be less than six. The printer 1 may discharge various types of ink from the heads 91 to 96, different from the ink of the above-described embodiment.

In the above-described embodiment, the platen 5 is provided to be movable in the up-down direction. In contrast to this, the heads 91 to 96 may be provided to be movable in the up-down direction. In this case, it is sufficient that the printer 1 raise the heads 91 to 96 in the processing from step S52 to step S56, for example, and lower the heads 91 to 96 in the processing at step S64. Both the platen 5 and the heads 91 to 96 may be provided to be movable in the up-down direction.

In the above-described embodiment, the platen 5 is provided to be movable in the front-rear direction. In contrast to this, the heads 91 to 96 may be provided to be movable in the front-rear direction. In this case, it is sufficient that the printer 1 move the heads 91 to 96 forward in the processing at step S22, for example. Both the platen 5 and the heads 91 to 96 may be provided to be movable in the front-rear direction.

One or both of the first sensor 47 and the second sensor 48 may be provided at a position different from that of the above-described embodiment. For example, the first sensor 47 and the second sensor 48 may be provided at the same position as each other in the front-rear direction. The second sensor 48 may be provided further to the rear than the first sensor 47. One or both of the first sensor 47 and the second sensor 48 may be provided further to the rear or further to the front than the front wall 21. The first sensor 47 is preferably provided further to the rear than the rear end of the platen 5 when the platen 5 is positioned at the set position. In this case, the printer 1 more easily detects the presence or absence of the wrinkle over the whole of the print medium M on the platen 5 from the front end to the rear end of the print medium M, using the first sensor 47. The first sensor 47 is preferably disposed further to the front than the front end of the head (the head 96 in the above-described embodiment) positioned furthest to the front among the plurality of heads 91 to 96. In this case, the printer 1 more easily detects, using the first sensor 47, the presence or absence of the wrinkle in the print medium M on the platen 5 before the print medium M on the platen 5 comes into contact with the heads 91 to 96, for example.

In the above-described embodiment, one or both of the first sensor 47 and the second sensor 48 may measure a distance in the up-down direction between the respective sensor and the print medium M by emitting light downward. The first sensor 47 and the second sensor 48 may detect the print medium M at the first detection position V1 or at the second detection position V2 in this way. In this case, the printer 1 may be provided with only one of the first sensor 47 and the second sensor 48. A type of sensor different from the reflective optical sensor may be employed as one or both of the first sensor 47 and the second sensor 48. For example, the first sensor 47 and the second sensor 48 may be a transmission type optical sensor, may be an image sensor, or may be a contact sensor. It is sufficient that the image sensor be provided at a position capable of recognizing the upper surface of the print medium M on the platen 5 from the left or from the right. In this case, the CPU 41 performs known filter processing that performs edge extraction on the basis of an image capture result by the image sensor, and identifies a contour (the upper surface) of the print medium M. In this way, the CPU 41 identifies whether or not the print medium M is at the first detection position V1. For the contact sensor, when the print medium M on the platen 5 has come into contact with the sensor, for example, the contact sensor detects the print medium M that has made contact.

In the above-described embodiment, the CPU 41 sets the first movement distance L1 and the second movement distance L2 in accordance with the operation of the input portion 46 by the user. In contrast to this, the first movement distance L1 and the second movement distance L2 may be stored in advance in the ROM 42. In this case, the second movement distance L2 may be the same as the first movement distance L1, may be smaller than the first movement distance L1, or may be greater than the first movement distance L1. The first movement distance L1 and the second movement distance L2 may be the same as the first detection distance D1, for example, or may be smaller or greater than the first detection distance D1. The first movement distance L1 and the second movement distance L2 may be the same as the second detection distance D2, for example, or may be smaller or greater than the second detection distance D2.

In the above-described embodiment, at step S64, the CPU 41 raises the platen 5 up to the reference position V3. In contrast to this, at step S64, the CPU 41 may raise the platen 5 by a third movement distance. The third movement distance may be the same as the first movement distance L1, may be smaller or greater than the first movement distance L1, may be the same as the second movement distance L2, or may be smaller or greater than the second movement distance L2. It is sufficient that the third movement distance be stored in advance in the ROM 42, and the third movement distance may be changed in accordance with an operation of the input portion 46 by the user.

In the above-described embodiment, the retry distance L3 is stored in advance in the ROM 42. In contrast to this, the CPU 41 may set the retry distance L3 in accordance with an operation of the input portion 46 by the user.

In the above-described embodiment, the first retry control is performed a maximum of two times per each print command. In contrast to this, after the retry number has reached 1, the CPU 41 may perform third error processing when the print medium M is detected by the first sensor 47. Also after the retry number has reached 2, the CPU 41 may move the platen 5 downward when the print medium M is detected by the first sensor 47.

In the above-described embodiment, when the print medium M is detected by the first sensor 47, and when the print medium M is not detected by the second sensor 48 (hereinafter referred to generically as "when the medium is detected"), the CPU 41 conveys the platen 5 to the front by the retry distance L3, at step S53, step S57, and step S65. In other words, in the above-described embodiment, the retry position is the position that is positioned to the front by the retry distance L3 from the position of the platen 5 when the medium is detected. In contrast to this, when the medium is detected, the CPU 41 may always convey the platen 5 to the same predetermined retry position at step S53, step S57, and step S65, regardless of the position of the platen 5 when the medium is detected. In this case, the retry distance L3 is not a predetermined distance, but is different depending on the position of the platen 5 when the medium is detected. The retry position when the print medium M is detected by the first sensor 47, and the retry position when the print medium M is not detected by the second sensor 48 may be mutually different positions. When the medium is detected, the CPU 41 may convey the platen 5 to the set position at step S53, step S57, and step S65.

In the above-described embodiment, the CPU 41 acquires the print command by the user operating the input portion 46, performs the setting in accordance with the first operation or performs the setting in accordance with the second operation. In contrast to this, the CPU 41 may receive various commands from an external device, such as a PC or the like, and may perform processing in accordance with the received command.

In the above-described embodiment, the predetermined time period is stored in advance in the ROM 42. In contrast to this, the CPU 41 may change the length of the predetermined time period in accordance with an operation of the input portion 46 by the user. In this case, the user can set the length of the predetermined time period in accordance with a tolerance of a size of the wrinkle, for example.

In the above-described embodiment, the CPU 41 can set ON and OFF for the first retry setting. In contrast to this, the ON and OFF settings for the first retry setting need not necessarily be provided in the printer 1. In this case, when the print medium M at the first detection position V1 is detected by the first sensor 47 (yes at step S24), the CPU 41 may determine whether or not the print medium M at the first detection position V1 is detected by the first sensor 47 for the time period equal to or greater than the predetermined time period (step S43). Similarly, the ON and OFF settings for the second retry setting need not necessarily be provided in the printer 1.

In the above-described embodiment, after lowering the platen 5 at step S52, the CPU 41 conveys the platen 5 to the front at step S53. In contrast to this, the CPU 41 may convey the platen 5 to the front before starting the lowering of the platen 5 at step S52. Furthermore, the CPU 41 may convey the platen 5 to the front while lowering the platen 5, by starting the conveyance of the platen 5 to the front at the same time as starting the lowering of the platen 5 at step S52, for example. Similarly, the printer 1 can also change a processing order of step S56 and step S57 and a processing order of step S64 and step S65 as necessary.

In the above-described embodiment, the CPU 41 may perform the processing at step S24 and step S25, on the basis of the detection signals from the first sensor 47 and the second sensor 48, during the period of conveying the platen 5 to the retry position at step S53, that is, during the period from the start of the processing at step S53 to the start of the processing at step S54. For example, when the platen 5 has not been sufficiently lowered, or when the platen 5 has been excessively lowered, the printer 1 can detect the presence or absence of the print medium M at the first detection position V1 or the second detection position V2 more rapidly, compared to when the printer 1 provisionally conveys the platen 5 to the retry position and then performs the processing at step S24 and step S25.

In the above-described embodiment, the printer 1 can change, as necessary, the content of the first error processing, the second error processing, the third error processing, and the fourth error processing. For example, in each of the error processing, the CPU 41 may perform the error notification in a state in which the platen 5 is stopped at a current position, without conveying the platen 5 to the set position. In each of the error processing, the CPU 41 may output the error to the external device, such as the PC or the like. In each of the error processing, the CPU 41 may cause the notification portion 45 to perform the error notification using the same notification mode.

In the above-described embodiment, an encoder may be provided in the raising/lowering motor 16. In this case, the CPU 41 may control the position of the platen 5 in the up-down direction by controlling the raising/lowering motor 16 on the basis of a detection result from the encoder. In the above-described embodiment, the printer 1 moves the platen 5 in the up-down direction using the ball screw 38 and the nut 39. In contrast to this, the printer 1 may move the platen 5 in the up-down direction using another mechanism. Similarly, the printer 1 may move the platen 5 in the front-rear direction using a mechanism different from the above-described embodiment.

In the above-described embodiment, the CPU 41 may omit the processing at step S43 and step S44. In other words, when the first retry setting is ON (yes at step S41), the CPU 41 may shift the processing to step S45, and may perform the first retry control.

In place of the CPU 41, a microcomputer, application specific integrated circuits (ASICs), a field programmable gate array (FPGA) or the like may be used as a processor. The main processing may be performed as distributed processing by a plurality of the processors. It is sufficient that the non-transitory storage media, such as the ROM 42, the flash memory 44, and the like be a storage medium capable of storing information, regardless of a period of storing the information. The non-transitory storage medium need not necessarily include a transitory storage medium (a transmitted signal, for example). The control program may be downloaded from a server connected to a network (not shown in the drawings) (in other words, may be transmitted as transmission signals), and may be stored in the ROM 42 or the flash memory 44. In this case, the control program may be stored in a non-transitory storage medium, such as an HDD provided in the server.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A printer comprising:

a head provided with a nozzle surface;

a platen configured to support a print medium, the platen configured to move relative to the head in a discharge direction of ink by the head, and in a conveyance direction intersecting the discharge direction;

a first sensor configured to detect the print medium positioned at a first detection position, the first detection position being separated by a first detection distance from the nozzle surface in the discharge direction;

a processor; and a memory storing computer-readable instructions that, when executed by the processor, cause the processor to perform processes comprising:

performing first conveyance processing of conveying the platen in the conveyance direction relative to the head, toward a printing position at which the nozzle surface faces the platen in the discharge direction;

performing first separation processing of moving the platen relative to the nozzle surface and separating the platen from the nozzle surface in the discharge direction, when the print medium is detected by the first sensor after a start of the first conveyance processing; and performing second conveyance processing of conveying the platen in the conveyance direction relative to the head, toward the printing position, after performing the first separation processing.

2. The printer according to claim 1, further comprising:

a storage configured to store a first setting or a second setting, wherein the computer-readable instructions stored in the memory further cause the processor to perform processes comprising:

performing the first separation processing when the print medium is detected by the first sensor after the start of the first conveyance processing in a state in which the first setting is stored in the storage; and performing first error processing of notifying an error, when the print medium is detected by the first sensor after the start of the first conveyance processing in a state in which the second setting is stored in the storage.

3. The printer according to claim 1, further comprising:

a second sensor configured to detect the print medium positioned at a second detection position, the second detection position being separated in the discharge direction from the nozzle surface by a second detection distance greater than the first detection distance, wherein the computer-readable instructions stored in the memory further cause the processor to perform processes comprising:

performing approach processing of moving the platen relative to the nozzle surface and causing the platen to approach the nozzle surface in the discharge direction, when the print medium is not detected by the second sensor after a start of the first conveyance processing or the second conveyance processing; and performing third conveyance processing of conveying the platen relative to the head in the conveyance direction, toward the printing position, after performing the approach processing.

4. The printer according to claim 1, wherein the computer-readable instructions stored in the memory further cause the processor to perform processes comprising:

in the first conveyance processing, conveying the platen relative to the head in the conveyance direction, from a set position, at which the print medium is attached to and removed from the platen, toward the printing position;

performing return processing of conveying the platen to a retry position before or after a start of the first separation processing, when the print medium is detected by the first sensor after the start of the first conveyance processing, the retry position being a position between the set position and a position of the platen when the print medium is detected by the first sensor; and in the second conveyance processing, conveying the platen relative to the head in the conveyance direction, from the retry position toward the printing position.

5. The printer according to claim 1, wherein the computer-readable instructions stored in the memory further cause the processor to perform processes comprising:

in the first separation processing, moving the platen relative to the nozzle surface in the discharge direction by a first movement distance;

performing second separation processing of moving the platen relative to the nozzle surface in the discharge direction by a second movement distance different from the first movement distance, when the print medium is detected by the first sensor after a start of the second conveyance processing; and performing fourth conveyance processing of conveying the platen relative to the head in the conveyance direction, toward the printing position, after performing the second separation processing.

6. The printer according to claim 1, wherein the computer-readable instructions stored in the memory further cause the processor to perform processes comprising:

performing the first separation processing, when the print medium is detected by the first sensor for a time period equal to or greater than a predetermined time period after the start of the first conveyance processing; and performing second error processing of notifying an error, when the print medium is detected by the first sensor for a time period less than the predetermined time period after the start of the first conveyance processing.

7. A control method of a printer, the control method comprising:

performing first conveyance processing of conveying a platen relative to a head in a conveyance direction, toward a printing position, the platen configured to support a print medium, the conveyance direction being intersecting to a discharge direction of ink by the head, and the printing position being a position at which a nozzle surface of the head faces the platen in the discharge direction;

performing first separation processing of moving the platen relative to the nozzle surface and separating the platen from the nozzle surface in the discharge direction, when, after a start of the first conveyance processing, the print medium is detected by a first sensor configured to detect the print medium positioned at a first detection position separated from the nozzle surface in the discharge direction by a first detection distance; and performing second conveyance processing of conveying the platen in the conveyance direction relative to the head, toward the printing position, after performing the first conveyance processing.

8. A non-transitory computer-readable medium storing computer-readable instructions that, when executed, cause a computer of a printer to perform processes comprising:

performing first conveyance processing of conveying a platen relative to a head in a conveyance direction, toward a printing position, the platen configured to support a print medium, the conveyance direction being intersecting to a discharge direction of ink by the head, and the printing position being a position at which a nozzle surface of the head faces the platen in the discharge direction;

performing first separation processing of moving the platen relative to the nozzle surface and separating the platen from the nozzle surface in the discharge direction, when, after a start of the first conveyance processing, the print medium is detected by a first sensor configured to detect the print medium positioned at a first detection position separated from the nozzle surface in the discharge direction by a first detection distance; and performing second conveyance processing of conveying the platen in the conveyance direction relative to the head, toward the printing position, after performing the first conveyance processing.

* * * * *